US009227134B1

(12) United States Patent
Rottier et al.

(10) Patent No.: US 9,227,134 B1
(45) Date of Patent: Jan. 5, 2016

(54) GAMING TABLE APPARATUS

(71) Applicant: NQDS, LLC, Shorewood, MN (US)

(72) Inventors: Eric Michael Rottier, Shorewood, MN (US); James Moorman, Bloomington, MN (US); Matthew Berbee, Shorewood, MN (US); David Beach, Shorewood, MN (US)

(73) Assignee: NQDS, LLC, Shorewood, MN (US)

( * ) Notice: Subject to any disclaimer, the term of this patent is extended or adjusted under 35 U.S.C. 154(b) by 0 days.

(21) Appl. No.: 14/533,932

(22) Filed: Nov. 5, 2014

(51) Int. Cl.
*A63F 9/04* (2006.01)
*A63F 3/00* (2006.01)
*G07F 17/32* (2006.01)

(52) U.S. Cl.
CPC ..... *A63F 3/00157* (2013.01); *A63F 9/04* (2013.01); *A63F 9/0468* (2013.01); *A63F 2003/00164* (2013.01); *A63F 2009/0408* (2013.01); *A63F 2009/0411* (2013.01); *G07F 17/32* (2013.01)

(58) Field of Classification Search
CPC ..... A63F 9/04; A63F 9/0468; A63F 9/0495; A63F 2009/0408; A63F 2009/0411; A63F 2003/00164; G07F 17/32
USPC ..... 273/309, 145 R, 145 A–145 E, 138.2; 463/22, 16, 46
See application file for complete search history.

(56) References Cited

U.S. PATENT DOCUMENTS

| | | | | |
|---|---|---|---|---|
| 491,971 | A | 2/1893 | Williams et al. | |
| 2,693,962 | A | 11/1954 | Stevens | |
| 3,831,948 | A | 8/1974 | Suda | |
| 3,834,713 | A | 9/1974 | Ito et al. | |
| 4,428,579 | A | 1/1984 | Miller | |
| 5,031,914 | A | 7/1991 | Rosenthal | |
| 5,449,174 | A | 9/1995 | Criner | |
| 5,556,101 | A * | 9/1996 | Jabro | A63F 3/00157 273/145 E |
| 5,885,157 | A | 3/1999 | Harada et al. | |
| 6,402,141 | B1 | 6/2002 | Verstraeten | |
| 6,755,416 | B2 | 6/2004 | Nakamoto et al. | |
| 7,744,087 | B2 | 6/2010 | Tseng | |
| 7,744,088 | B2 | 6/2010 | Tseng | |
| 7,775,522 | B2 | 8/2010 | Tseng | |
| 7,780,166 | B1 * | 8/2010 | Paxton | A63F 1/04 273/145 C |
| 7,857,310 | B2 | 12/2010 | Yoshizawa | |
| 7,874,905 | B2 | 1/2011 | Yoshizawa | |
| 8,079,593 | B2 | 12/2011 | Nicely et al. | |
| 8,109,832 | B2 | 2/2012 | Hsu et al. | |
| 8,210,923 | B2 | 7/2012 | Kido et al. | |
| 8,215,640 | B2 | 7/2012 | Sasaki | |
| 8,235,812 | B2 | 8/2012 | Baerlocher et al. | |
| 8,376,362 | B2 | 2/2013 | Nicely et al. | |
| 8,419,550 | B2 | 4/2013 | Anthony et al. | |

(Continued)

FOREIGN PATENT DOCUMENTS

| | | |
|---|---|---|
| EP | 0 635 289 | 1/1995 |
| WO | WO 2009/019674 | 2/2009 |

*Primary Examiner* — Benjamin Layno
(74) *Attorney, Agent, or Firm* — Merchant & Gould P.C.

(57) ABSTRACT

A dice game system is disclosed. The dice game system includes a table, a controller, and a plurality of electronically-actuated dice play stations. The dice play stations can include lighting components and dice agitators that are in electrical communication with the controller and a button positioned at the play station. The dice agitators can be actuated simultaneously by the controller and individually by a user positioned at a play station. The lighting components can indicate different stages of game play. A method for controlling a game on a game table is also disclosed.

17 Claims, 10 Drawing Sheets

(56) References Cited

U.S. PATENT DOCUMENTS

| | | | | |
|---|---|---|---|---|
| 8,430,408 | B2 | 4/2013 | Baerlocher et al. | |
| 8,622,391 | B2 | 1/2014 | Nicely et al. | |
| 2008/0246214 | A1 | 10/2008 | Toyoda | |
| 2008/0248864 | A1* | 10/2008 | Toyoda | A63F 9/0406 463/22 |
| 2009/0256310 | A1 | 10/2009 | Sanchez | |
| 2011/0018194 | A1* | 1/2011 | Nicely | A63F 9/0406 273/145 CA |

* cited by examiner

GAMING TABLE APPARATUS

BACKGROUND

Many games can be played with dice. Dice games are often played among multiple people and the game players often are consuming food or beverages during the games. Additionally, dice games are often played in public establishments, such as bars, restaurants, and casinos.

Some dice players are capable of purposely influencing the outcome of a dice roll. Ensuring that a dice roll is truly random is difficult when humans are shaking the dice. It is with respect to this general environment that the embodiments of the present application are directed.

SUMMARY

In summary, the present disclosure relates to a gaming table apparatus having separate, electronically actuated gaming stations for play of a game of chance having player involvement and skill, such as a dice game. The gaming table apparatus allows for player input, while removing direct player interaction with gaming components (e.g., dice) thereby reducing chances of a player directly influencing gaming outcomes by a manner in which the gaming components are actuated (e.g., dice are rolled).

In a first aspect, a game table includes a controller, a control button in electrical communication with the controller, and a plurality of play stations. Each play station includes a dice area including an electronically actuated agitator in electrical communication with the controller, an agitator control button in electrical communication with the controller, and a lighted indicator in electrical communication with the controller.

In a second aspect, a method for controlling game play on a game table is disclosed. The method includes receiving a game type selection, lighting at least one indicator light a first color, and receiving a game start selection. The method further includes actuating a plurality of electronic dice agitators, wherein the at least one electronic dice agitator is integral with the game table, and enabling independent actuation of each of the plurality of electronic dice agitators. The method further includes disabling, after a period of time, all of the plurality of electronic dice agitators.

In a third aspect, a multi-player gaming system is disclosed. The system includes a table, a controller positioned within the table and a plurality of dice receptacles, integral with the table, each containing at least one die therein. Each of the plurality of dice receptacles includes a lighting component and mechanical means for agitating the at least one die. Each of the lighting components and each of the agitators are operatively connected to the controller. The agitators are electronically actuated by the controller. The system further includes at least one input button for initiating each agitator.

DETAILED DESCRIPTION

Figure 1:
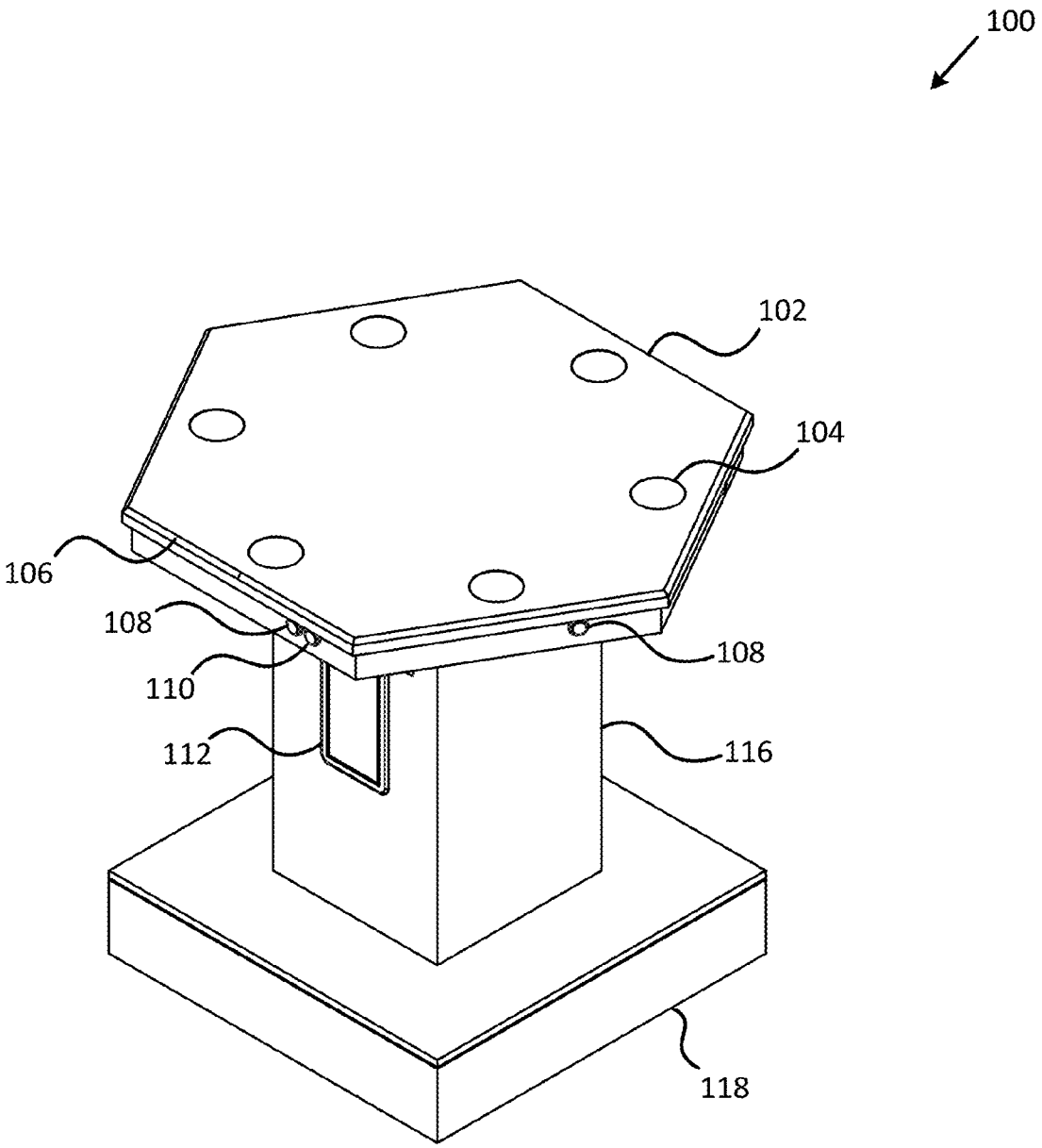
FIG. 1 is an isometric view of a gaming table apparatus according to an example embodiment of the present disclosure.
Figure 2:
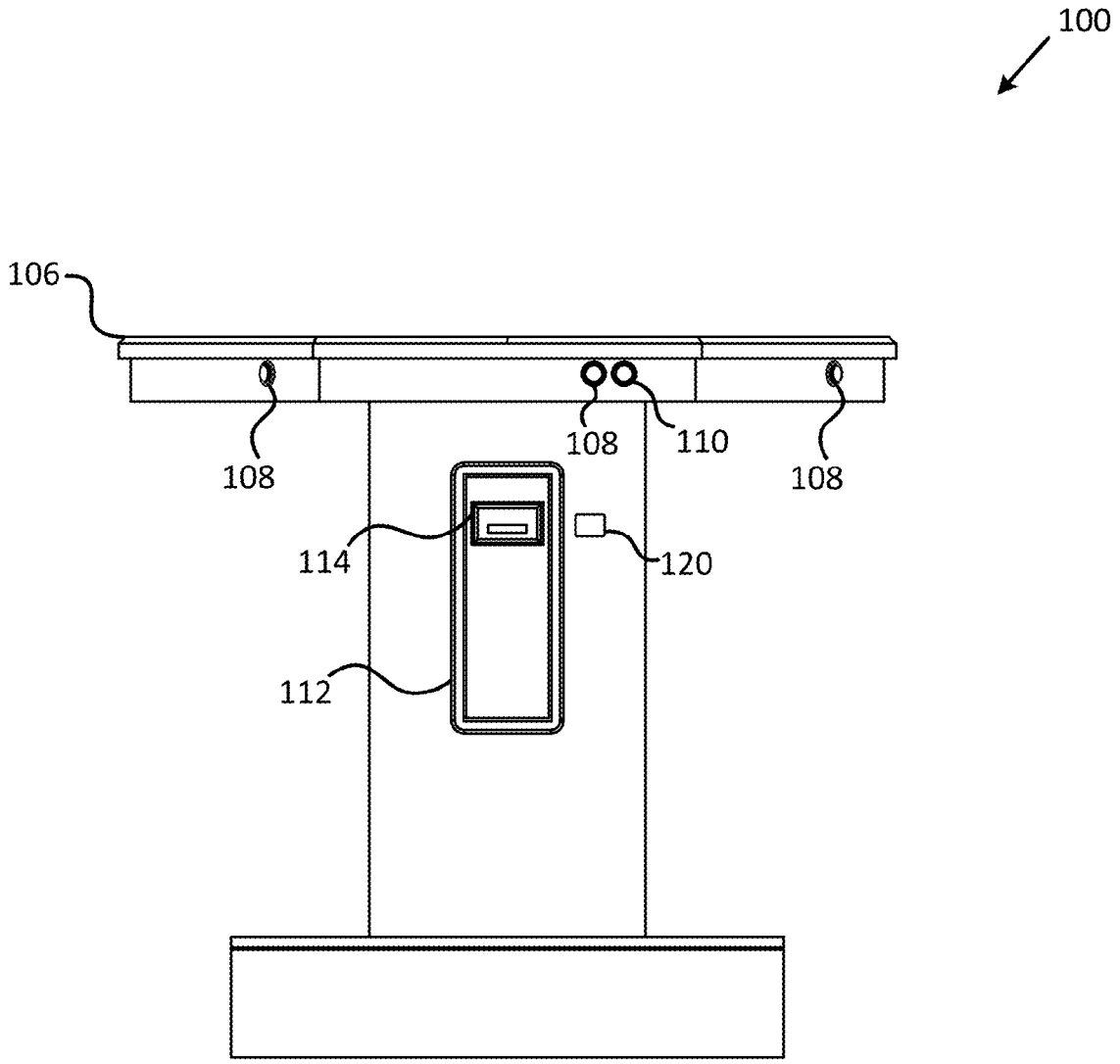
FIG. 2 is a front view of a gaming table apparatus according to an example embodiment of the present disclosure.
Figure 3:
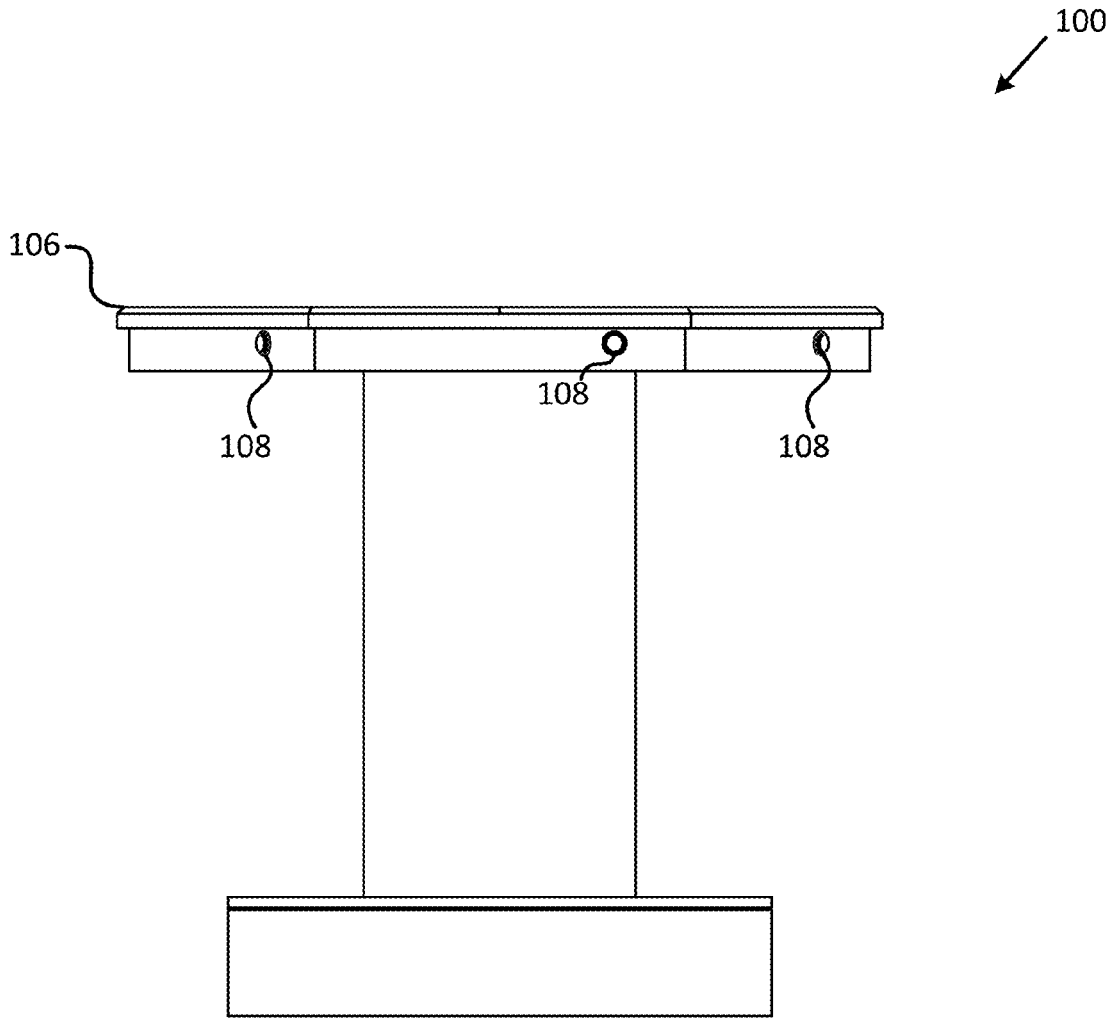
FIG. 3 is a rear view of a gaming table apparatus according to an example embodiment of the present disclosure.
Figure 4:
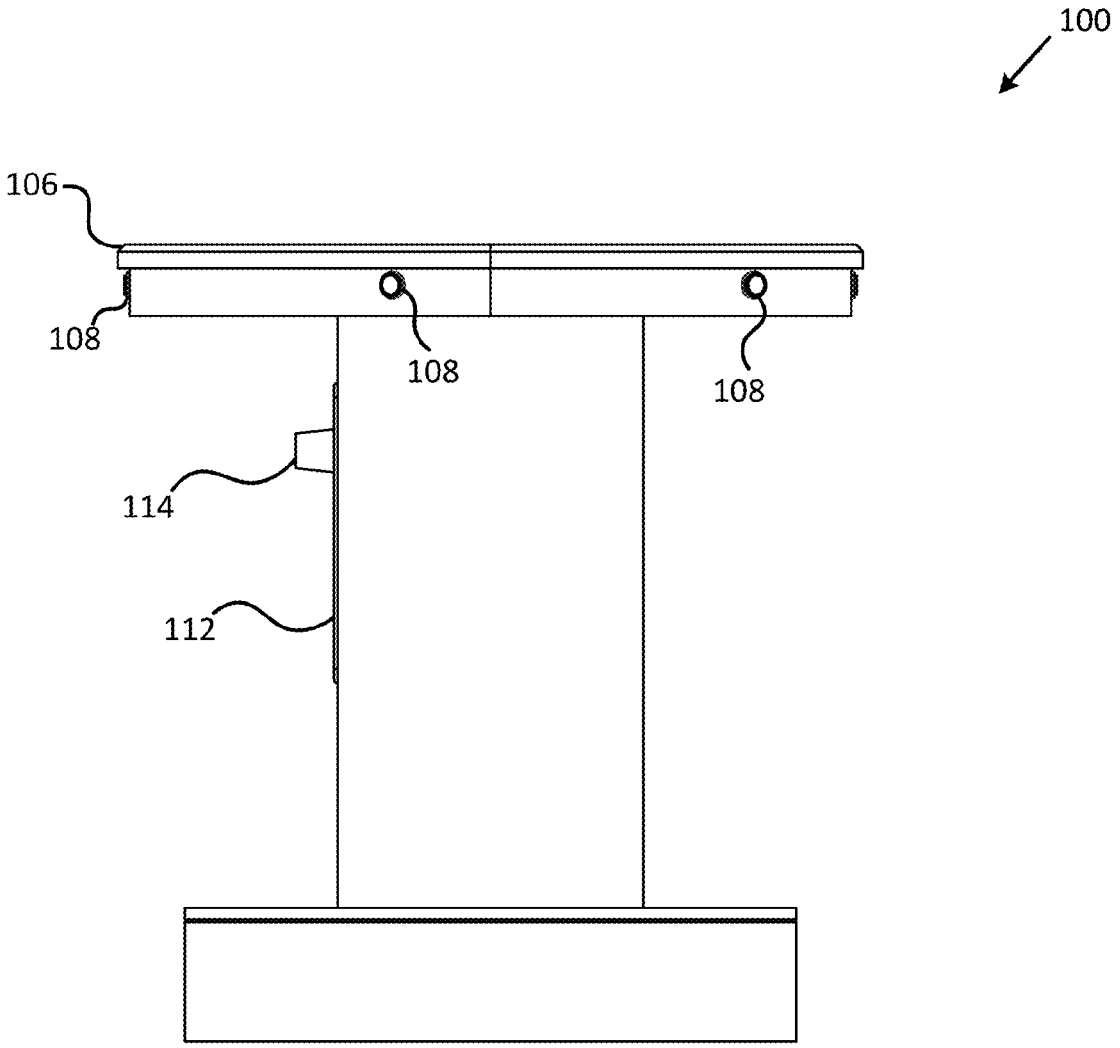
FIG. 4 is a right side view of a gaming table apparatus according to an example embodiment of the present disclosure.
Figure 5:
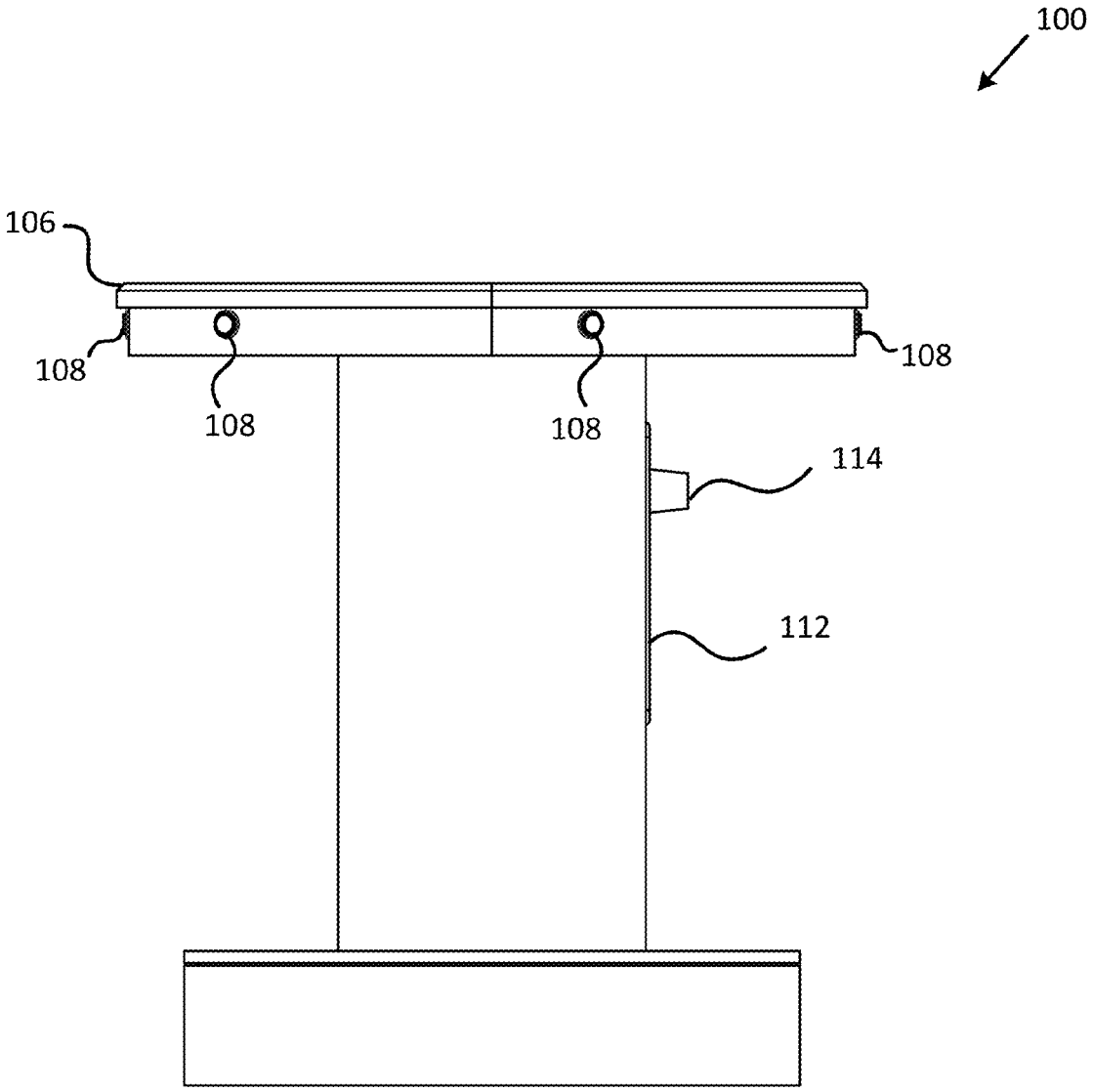
FIG. 5 is a left side view of a gaming table apparatus according to an example embodiment of the present disclosure.
Figure 6:
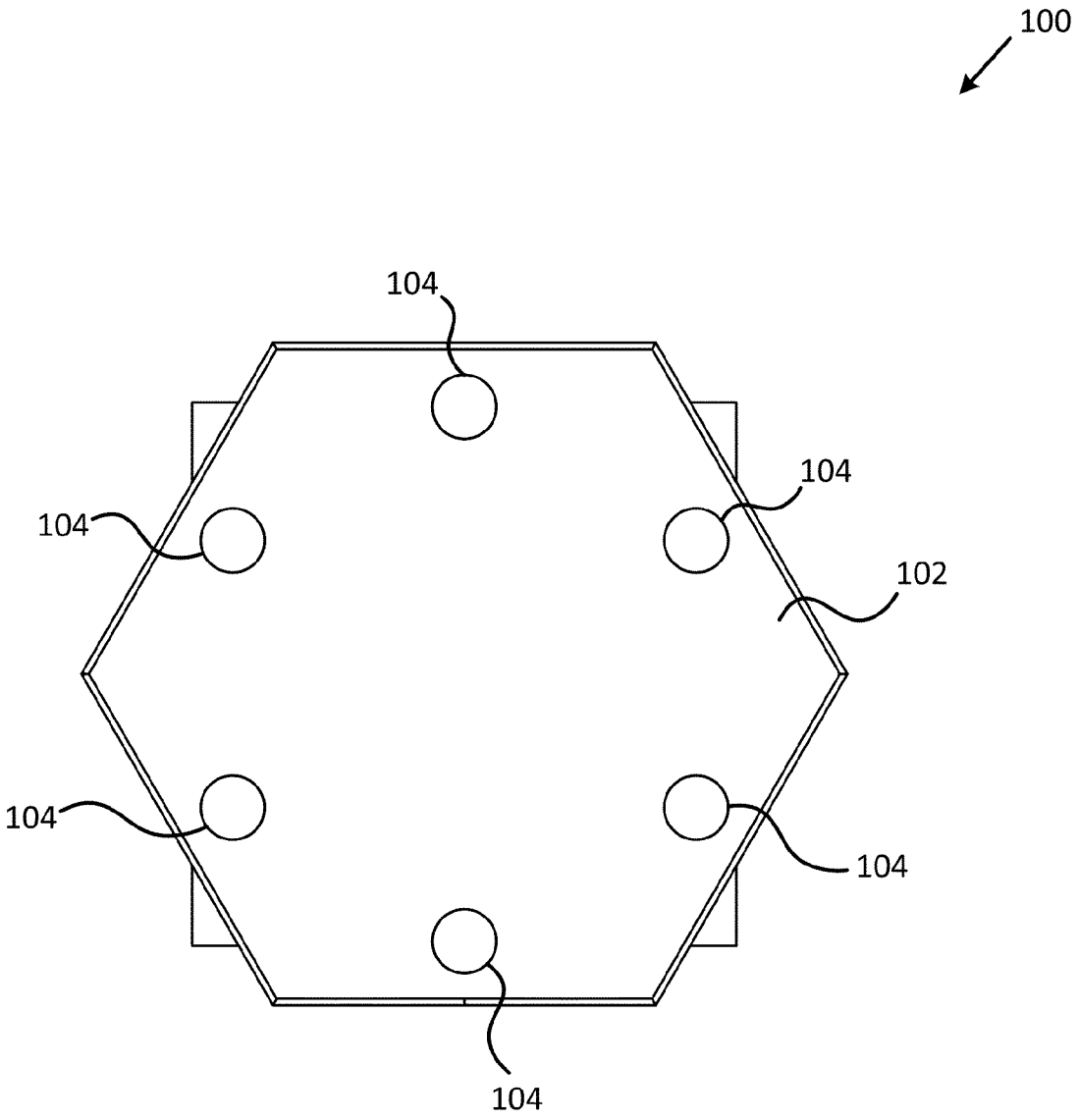
FIG. 6 is a top view of a gaming table apparatus according to an example embodiment of the present disclosure.
Figure 7:
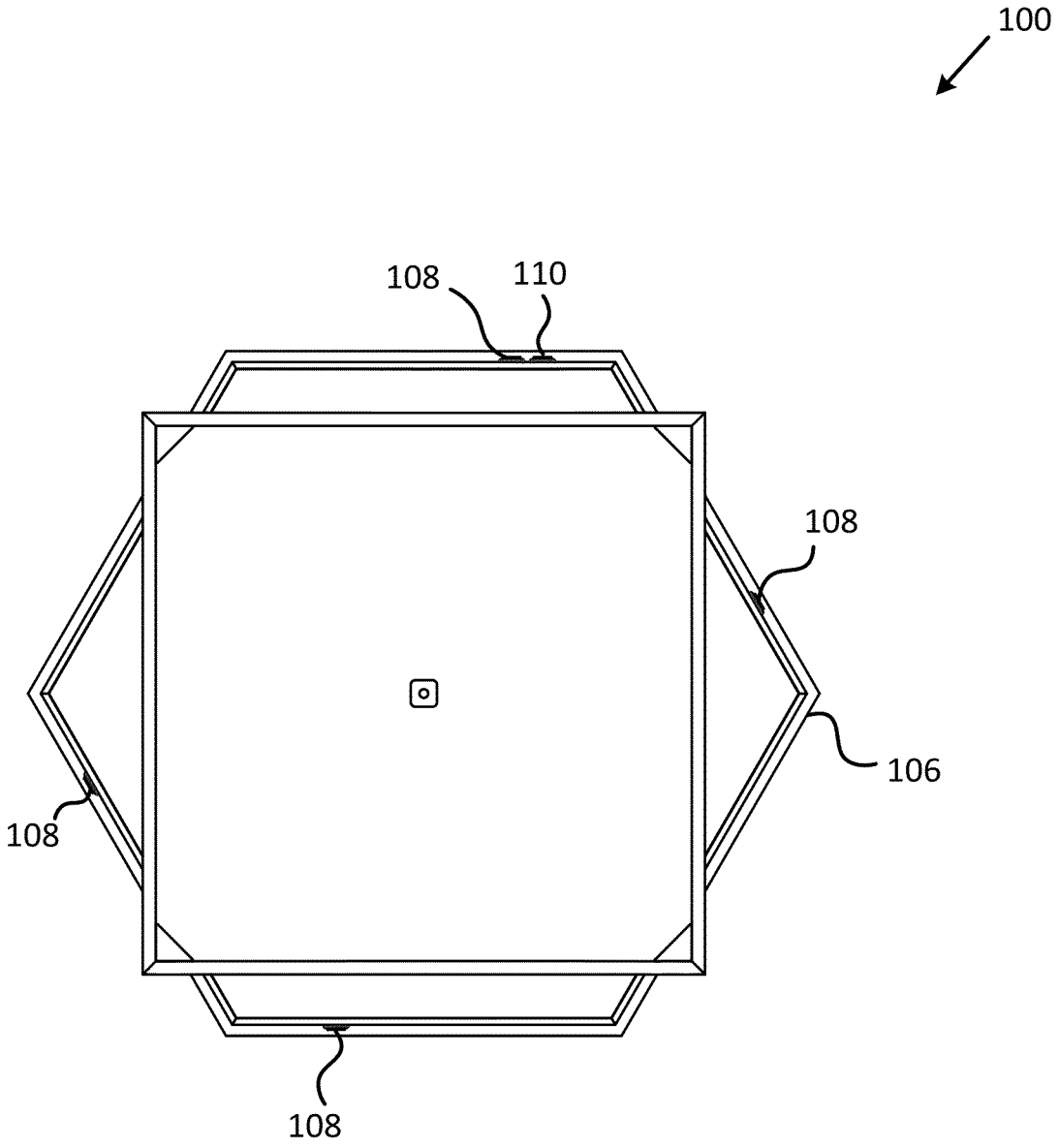
FIG. 7 is a bottom view of a gaming table apparatus according to an example embodiment of the present disclosure.

As briefly described above, embodiments of the present invention are directed to a gaming table apparatus, as well as a method for its use. In general, the gaming table apparatus described herein provides an enclosed system allowing for separate, concurrent multiplayer gaming, thereby providing a competitive and/or cooperative environment that allows player involvement through actuation of a dice agitator, while preventing user influence or interference with the gaming experience by providing a shielding, self-enclosed gaming area for each player. Furthermore, because the gaming experience is synchronized and self-enclosed, the gaming table apparatus of the present disclosure is easily provided at public establishments, such as bars and/or restaurants, without the risk of loss of dice, influence of the game, or other distractions that may otherwise interfere with enjoyment of gameplay.

In accordance with the present disclosure, an example gaming table apparatus 100 is illustrated in FIGS. 1-7. As illustrated, the gaming table 100 includes a top portion 102, a plurality of dice areas 104, cover or covers 106, dice agitator buttons 108, universal control button 110, payment system 112, cash receiver 114, and display 120. The example gaming table 100 includes six play stations, where each play station includes a dice agitator button 108 and a dice area 104. Other embodiments can include more or fewer components, such as more or fewer play stations and corresponding buttons 108.

The gaming table apparatus 100 can be made of any material, such as wood, plastic, steel, aluminum, etc. In the example embodiment shown, the top portion 102 is supported by a stand 116 and base 118. In embodiments, the top portion 102 can be secured to the stand 116. In other embodiments, the top 102, stand 116 and base 118 are partially or substantially continuous. The top 102, stand 116, and base 118 may be separable from one another for transportation. In some embodiments, the stand 116 houses the payment system 112.

A control unit, not shown in FIG. 1 (described below), has electrical connections to, for example, buttons 108 and 110, dice agitators, and payment system 112, and is positioned within the top portion 102 and/or the stand 116 or base 118.

In the example embodiment shown, the top portion 102 is hexagonal in shape. In other embodiments, the top portion 102 has a different shape, such as circular, oval, triangular, square, rectangular, pentagonal, heptagonal, etc. In addition, in the example embodiment shown, the stand 116 and base 118 have a square or rectangular cross-sectional shape. However, in other embodiments, the stand 116 and/or base 118 can have other shapes. For example, in some embodiments, the stand 116 and base 118 can be hexagonal in cross-sectional shape, for example to be complementary to the top portion 102.

Figure 8:
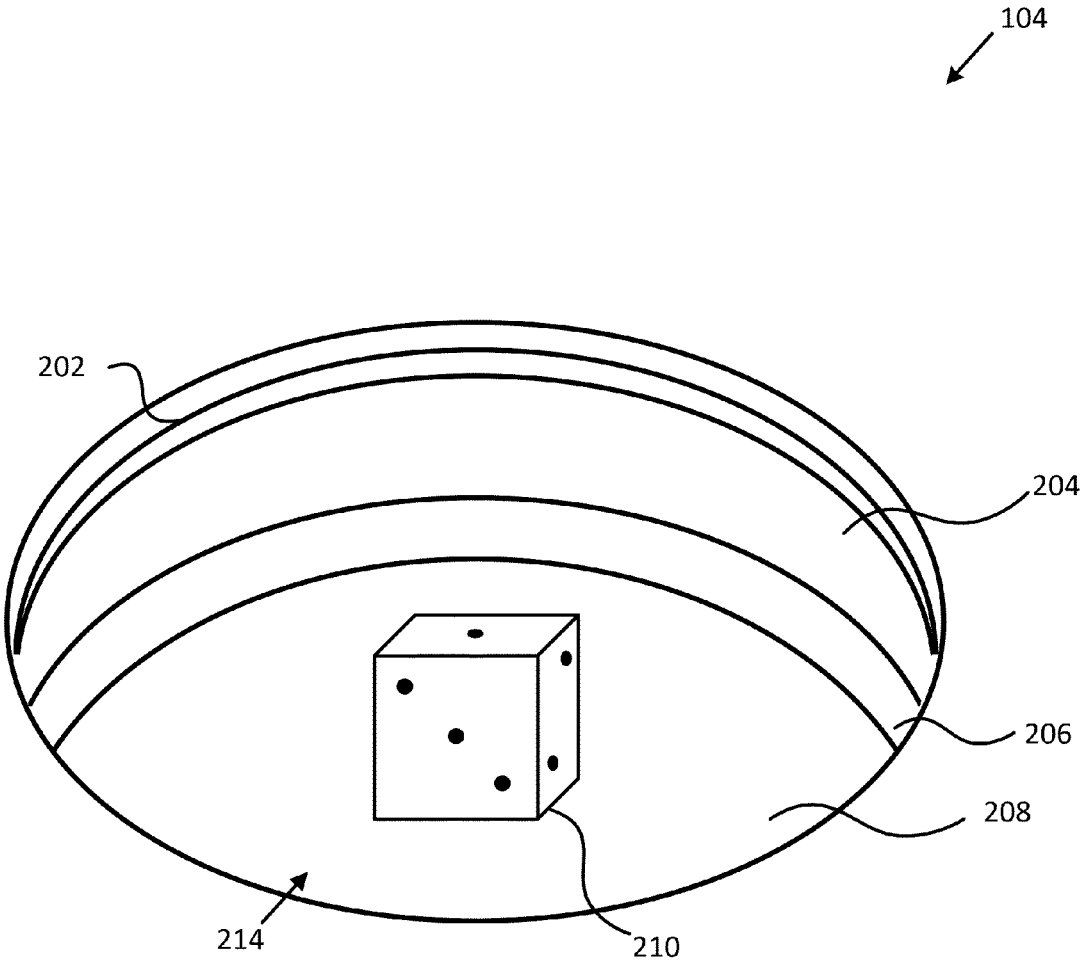
FIG. 8 is a perspective view of a dice cup area, according to one possible embodiment.

In some embodiments, the example top portion 102 has one or more round holes in the top surface, leading to cylindrical depressions (e.g., as seen in FIG. 8). The holes at least partially form the one or more dice areas 104, which are also, in the embodiment shown, cylindrical in shape. In some embodiments, the bottom surfaces of the one or more dice areas 104 are positioned near the top surface of the top portion 102. In other embodiments, the bottom surfaces of the one or more dice areas 104 are positioned on or on top of the top surface of the top portion 102. The dice areas 104 can be other shapes as well.

In some embodiments where the top portion 102 is a polygon, the number of dice areas 104 can be equal to, less than, or greater than the number of sides of the polygon. The dice areas 104 can be equally spaced from the centroid of the polygon and from each other. The dice areas 104 can be positioned at or near the midpoint of each side of the polygon and there can be anywhere from 1 to 12 inches from the edge of the top portion to the nearest edge of the dice area 104. In alternative embodiments, the number of size of the top portion has no correlation with the number of dice areas 104 and/or dice agitator buttons 108 (e.g., in the case of a round shaped top portion 102).

In particular embodiments where the top portion 102 is a circle or oval, there can be anywhere from 1 to 10 dice areas 104. The dice areas 104 can be equally spaced from the center of the circle, or centroid of the oval, and equally spaced from each other. Other spacings of dice areas 104 and associated dice agitator buttons 108 are possible as well.

In embodiments, the top portion 102 can also include additional recesses, such as recesses designed to support beverage containers or poker chips, to support other gameplay. In embodiments, the top portion 102 can also include a tablet computing device or other touch-screen computing device, which is not depicted in the embodiment shown in FIG. 1. The tablet computing device or other touch-screen computing device, or other display device, can be used to display or track scores regarding gameplay, present advertisements to players, or other messages to players explaining gameplay or other messages.

The dice areas 104 contain at least one die. In embodiments, each dice area 104 has a dice agitator, such as a spinner, positioned therein. An example embodiment of a dice area 104 is shown and described in more detail with reference to FIG. 8, below.

The example top portion 102 can have one or more covers 106. In embodiments, the cover is a clear material that is resistant to liquid and easy to see through, such as transparent thermoplastic. In some embodiments, cover 106 is a single sheet that is positioned and secured to the top surface of top portion 102. The cover 106 can have substantially the same shape as top portion 102.

In other embodiments, cover 106 is sized to fit over the top of the recessed dice areas 104, where the top surface of the cover 106 is substantially flush with the top surface of top portion 102. In some cases, separate covers 106 can be secured to the dice areas 104. Alternatively, the covers can be removably attached, such as by hinge or by sliding, not shown, to enable the removal or addition of dice to the dice area.

In the example game table apparatus 100, agitator control buttons 108 are positioned at each play station. Agitator control buttons 108 can be located on the side of the top portion 102, as shown in FIG. 1. In other embodiments, the buttons 108 are located on the top or bottom surface of the top portion 102.

The agitator control button 108 at a particular play station is in electrical communication with the dice agitator at that play station (e.g., via a controller as discussed in connection with FIG. 9, below). A player at a play station can use the agitator control button 108 to initiate one or more agitations of the play station's dice area 104. The agitator control button 108 may be deactivated during a portion of, or for the entirety of, a game play.

Universal control button 110 can be positioned on the side of the top portion 102, as shown in example embodiment 100, on the top or bottom of top portion 102, or on the stand 116. Universal control button 110 is in electrical communication with the controller and the display 120. In embodiments, the universal control button 110 can be used to select the type of game to be played and/or to initiate a game play. In some cases, the universal control button 110 can initiate gameplay by activating all of the agitators at each of the dice areas 104.

Payment system 112 is an optional component that is shown in the example gaming table 100. In some embodiments, the gaming table 100 is located in public areas, such as a restaurant, arcade, bar, lounge, or casino. In embodiments, payment system 112 includes a cash receiver 114. In embodiments the payment system 112 can process credit cards. In embodiments, the payment system 112 can receive payment from a wireless computing device, such as contactless near-field communication, for example, Apple Pay.

Display 120 is positioned on the table 100 and is in electrical communication with the controller and the payment system 112. In embodiments, the display 120 indicates the number of credits available for play and/or the game type. In some embodiments, a player can cycle through the game types using the universal control button 110, with the game type shown on the display.

In embodiments, a touch-screen computing device positioned on the table 100 replaces one or more of the universal control button 110, payment system 112 and display 120.

FIG. 8 is a perspective view of an example dice cup area 104 that is recessed in the top portion 102, according to an example embodiment. The example dice cup area 104 includes a clear cover ledge 202, lighted indicator 204, a dice agitator 206 with base 208, and a die 210 in the dice cup 214. As shown, the dice cup area 104 is substantially cylindrical in shape. Other embodiments can include more or fewer components or have a different shape.

The clear cover ledge 202 is an optional component of the dice cup area 104 and supports a clear, substantially planar cover 106 that is positioned to provide an upper surface of the dice cup area 104. In some embodiments, the cover 106 is secured to the cover ledge 202 by, for example, an adhesive. In some embodiments, the cover 106 is fixed to the top surface 102 but can be moved to provide access to the dice cup 214, for example, by a hinge. In some embodiments, the dice area 104 additionally includes a recess sized to receive some or all of the cover 106. The recess provides a space for the cover to be slid, in a direction parallel to the top surface of top 102, and provide access to the dice cup 214.

In some embodiments, the cover 106 covers substantially all of the top surface of the top portion 102. In those embodiments, the clear cover ledge 202 may not be present because the cover 106 provides the upper surface for all the dice areas 104. In some embodiments, the clear cover ledge 202 supports a clear dome. In other embodiments, there is no cover 106 over the dice area.

In the example embodiment, the lighted indicator 204 is ring-shaped and defines part of the lateral walls of the dice cup 214. The lighted indicator 204 is one or more lights around most or all of the circumference of the dice cup 214.

The lighted indicator 204 is in electrical communication with the controller, which controls the color and display pattern of the lighted indicator 204. In embodiments, the lighted indicator 204 is capable of producing various colors, such as the colors produced by a multi-die light-emitting diode (LED). In some embodiments, the lighted indicator 204 is constructed of a scratch or wear-resistant material. In alternative embodiments, the lighted indicator need not extend along the entire ring of the dice cup 214, but can instead be presented to the user via a light or display indicator in proximity to the dice cup 214 (e.g., alongside but outside of the dice cup).

In the example embodiment, dice agitator 206 forms the bottom surface of the base 208. The dice agitator 206 is electrically actuated by the controller. In embodiments, the dice agitator 206 agitates the die or dice by a spinning motion. Examples of dice agitators are known in the art. In embodiments, the dice agitator 206 forms part of the lateral wall of the dice cup 214.

Positioned in the dice cup 214 is a die or a plurality of dice 210. As described above, in some embodiments, the dice cup area 104 is sealed. In those embodiments, one, two, three, four, five, six, seven, or eight dice may be positioned within each dice cup 214. In embodiments where the well is accessible, there can be any number of dice positioned within each dice cup 214. In some embodiments, the dice are six-sided. In other embodiments, the dice have 4, 8, 10, 12, or 20 sides. Other dice with a different number of sides are possible. In some embodiments, the dice in the dice cup 214 have different numbers of sides.

In other embodiments, the dice cup area 104 can additionally include a view blocker, not shown. The view blocker can be sized and positioned such that a neighboring player is obscured from viewing the dice in the dice cup 214 of other players. In these embodiments, the view blocker can be removable from the table 100.

Figure 9:
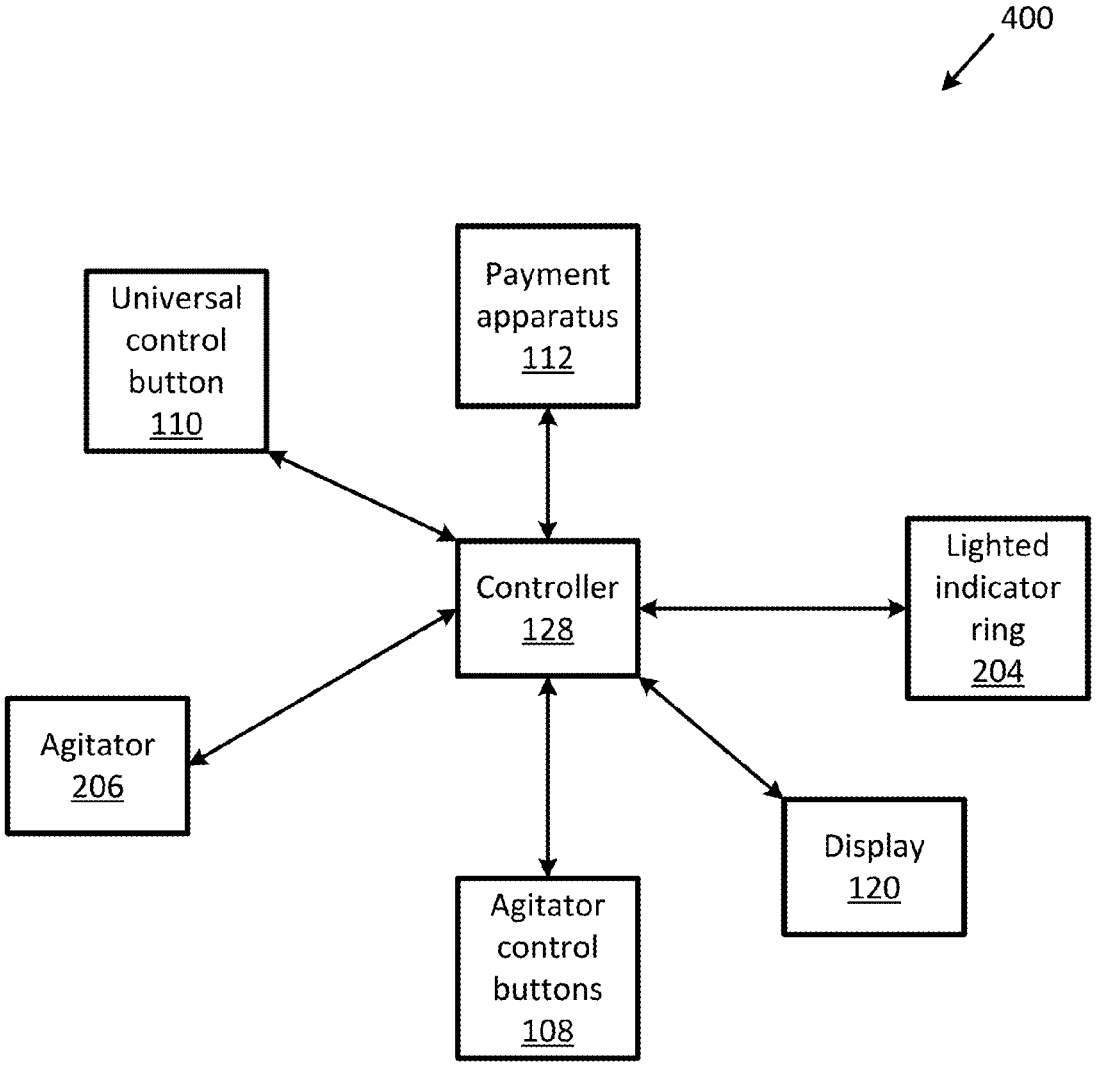
FIG. 9 is a block diagram of the connections between electrical components, according to one possible embodiment.

FIG. 9 is a block diagram 400 showing the logical connections between components in the example gaming table 100. The example connections 400 include the controller 128, the lighted indicator ring 204, the display 120, the agitator control buttons 108, agitator 206, universal control button 110, and payment apparatus 112. Embodiments with a tablet computer or touch-screen computing device include a logical connection between the computing device and the controller. The components in FIG. 9 can be used to implement the method shown and are described in more detail with reference to FIG. 10, below. It is further noted that although a single agitator 206 and lighted indicator ring 204 are illustrated, as well as a single agitator control button 108, separate sets of each of these components may be provided for each player area at the gaming table of the present disclosure.

In an example embodiment, a controller 128 is used to control the systems of FIGS. 1-7. In general, the controller 128 includes a processor communicatively connected to a memory via a data bus. The processor can be any of a variety of types of programmable circuits capable of executing computer-readable instructions to perform various tasks, such as algorithms and mathematical and communication tasks. The memory can include any of a variety of memory devices, such as using various types of computer-readable or computer storage media. A computer storage medium or computer-readable medium may be any medium that can contain or store the program for use by or in connection with the instruction execution system, apparatus, or device. In the context of the present disclosure, a computer storage medium includes at least some tangible component, i.e., is not entirely consisting of transient or transitory signals.

Figure 10:
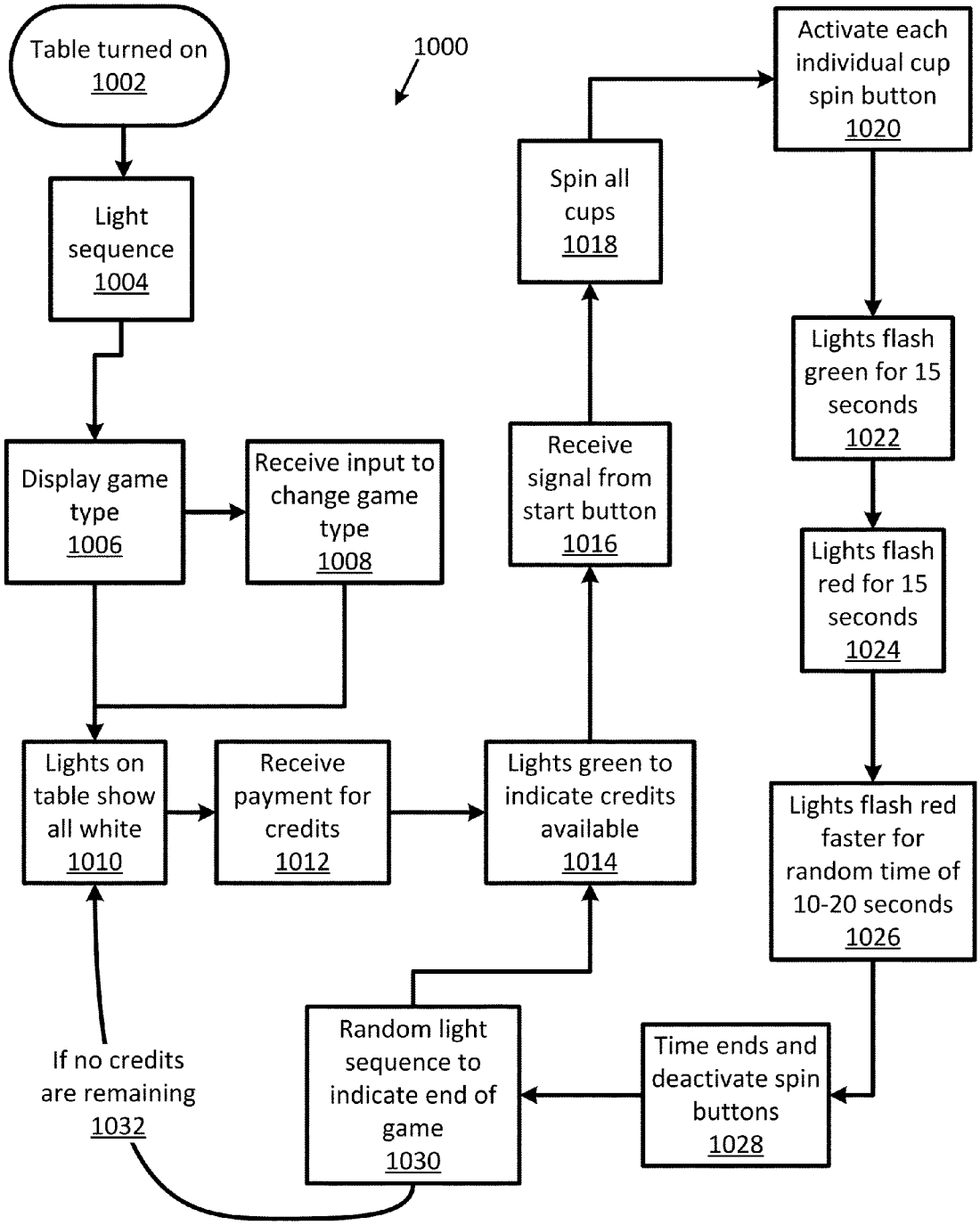
FIG. 10 is a block diagram illustrating a general logic flow of the control unit according to an example embodiment of the present disclosure.

FIG. 10 is a block diagram of an example method 1000 for implementing a game play with the example gaming table 100. The example method 1000 includes turning the table on (step 1002), an introductory light sequence (step 1004), display game type (step 1006), receive input changing the game type (step 1008), lights on the table showing all white (step 1010), receiving payment for credits (step 1012), lights green to indicate credits available (step 1014), receive signal from start button (step 1016), spin all cups (step 1018), activate each individual cup spin button (step 1020), lights flash green for 15 seconds (step 1022), lights flash red for 15 seconds (step 1024), lights flash red faster for random time of 10-20 seconds (step 1026), time ends and deactivates spin buttons (step 1028), and random light sequence to indicate end of game (step 1030). Other embodiments can include more or fewer steps.

The example method 1000 begins with the gaming table 100 being turned on (step 1002). In some embodiments, the gaming table 100 is configured to be powered by a main power supply of a building. Battery-powered embodiments are possible. In some embodiments, the gaming table 100 has an on/off button or switch.

After the table is turned on (step 1002), the controller initiates a light sequence (step 1004) on the one or more lighted indicators. The light sequence can be random or preprogrammed. The light sequence can include multiple colors that are displayed.

After the table is turned on (step 1002), the controller displays the game type (step 1006) on display 120 or on the touch screen computing device. In embodiments where the display 120 can only show two decimal digits, different combinations of numbers are used to indicate the game type. For example, "55" on the display 120 can indicate a standard game and "88" on the display 120 can indicate a random game. Other games may be presented to users as well.

A user can press the universal control button 110 to cycle through the various game types. The controller receives the user's selection at step 1008. In other embodiments, the controller can receive the game type after receiving payment for credits (step 1012) and before spinning the cups (step 1018).

In embodiments, the controller then changes the lighting display on the lighted indicators 204 so that all lighted indicators 204 appear white (step 1010). In embodiments, this display of white is solid, that is, not blinking or flashing.

Next, the system can receive payment to be used for game credits (step 1012). In embodiments, payment can be cash or coin and received by the payment apparatus 112 and 114. In other embodiments, payment can be made using a wireless computing device, such as a smart phone. In embodiments, a minimum number of credits, corresponding to a monetary amount, is required for the game play.

If the controller 128 determines that the credits are sufficient, the controller changes the lighted indicators 204 to display a solid green color (step 1014). If the tendered payment is not sufficient for a game play, the lighted indicators 204 can remain a solid white color.

In some embodiments, the controller 128 can receive an input indicating the number of players positioned at the play stations, not shown in FIG. 10.

After receiving the credits (step 1012), the controller 128 can next receive a signal to start the game play (step 1016). In embodiments, the universal control button 110 is used to initiate the game play.

Then the controller 128 electronically actuates each dice cup agitator 206 (step 1018). In step 1018, each agitator 206 starts and stops spinning at the same time. In embodiments, the spinning can last for about 0.5 second, about 1 second, about 3 seconds, about 5 seconds, about 10 seconds, about 15 seconds, or about 20 seconds. In embodiments, during step 1018, the controller can also change the flashing status and/or color of the lighted indicators 204. In embodiments, during step 1018, each agitator control button 108 is deactivated.

After actuating each dice cup agitator 206 (step 1018), the controller 128 activates the agitator control button 108 at each play station (step 1020). At step 1018, each player can spin the agitator 206 for various periods of time by pressing the agitator control button 108. The player only has control over the dice cup 104 at his/her play station.

When each agitator control button 108 is activated, the lighted indicators 204 flash green for about 15 seconds (step 1022). In other embodiments, the lighted indicators 204 flash green, or a different color, for about 3 seconds, for about 5 seconds, for about 10 seconds, for about 20 seconds, or for about 25 seconds.

In embodiments, after a period of time where the lighted indicators 204 flash green (step 1022), the lighted indicators flash for about 15 seconds (step 1024). In other embodiments, the lighted indicators 204 flash red, or a different color, for about 3 seconds, for about 5 seconds, for about 10 seconds, for about 20 seconds, or for about 25 seconds. This can provide an indication about the time remaining for individually actuating the dice cup at each play station.

In embodiments, the pulse rate of the flashing can accelerate (step 1026) for about 10 to about 20 seconds. The increase can be a step increase, for example, from 2 pulses per second in step 1024 to 4 pulses per second in step 1026. Alternatively, the increase can be a linear increase, where the pulse rate increases over time. In embodiments, the accelerated flashing period (step 1026) can last for about 3 seconds, for about 5 seconds, for about 10 seconds, for about 20 seconds, or for about 25 seconds.

Then the time for individual actuation of the agitators 206 ends and the controller deactivates each agitator control button 108 at the same time (step 1028). At this step, each user cannot continue to agitate the dice. Concurrently, the controller can initiate a random light sequence that indicates the spinning period, or the game, has ended (step 1030). At this point, players may determine a winner, and may indicate the winner on a display 120 or other scoring system provided by the gaming table apparatus 100.

If there are no credits remaining for additional game play, the method 1000 returns to step 1010 (step 1032) and the lighted indicators 204 display solid white. If there are credits remaining, the method 1000 returns to step 1014 and the lighted indicators 204 display green to indicate credits are available.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A game table, comprising:
- a controller;
- a control button in electrical communication with the controller; and
- a plurality of play stations,
- wherein each play station includes:
  - a dice area including an electronically-actuated agitator in electrical communication with the controller;
  - an agitator control button in electrical communication with the controller; and
  - a lighted indicator in electrical communication with the controller;
- wherein the controller is configured to actuate the plurality of agitators simultaneously;
- wherein the controller actuates the plurality of agitators during a first time period;
- wherein each of the plurality of agitators can be actuated independently during a second time period; and
- wherein the controller prevents actuation of the plurality of agitators during a third time period.

2. The game table of claim 1, wherein each dice area is substantially cylindrical and recessed in the table surface,
- wherein the lighted indicator is disposed circumferentially in the dice area, and
- wherein the recess is defined at least in part by the lighted indicator and the electronically-actuated agitator.

3. The game table of claim 2, wherein the lighted indicator is a multi-color light-emitting diode.

4. The game table of claim 3, further comprising a transparent layer positioned on the top surface of the game table, wherein the transparent layer forms a top surface of the plurality of dice areas.

5. The game table of claim 3, wherein the controller is configured to cause each of the lighted indicators to flash during a game play period.

6. The game table of claim 1, further comprising a payment system operatively coupled to the controller and configured to accept and process a value tendered, and
- wherein the controller is configured to actuate the electronically-actuated agitators only when the value tendered is equal to or greater than a minimum value.

7. The game table of claim 1, further comprising:
- a removable and transparent cover positioned over each dice area.

8. The game table of claim 1, wherein at least one die is positioned within each of the plurality of dice areas.

9. The game table of claim 1, further comprising a touch-sensitive computing screen supported by the table and operatively coupled to the controller.

10. A method for controlling game play on a game table, comprising:
- receiving a game type selection;
- lighting at least one indicator light a first color;
- receiving a game start selection;
- actuating a plurality of electronic dice agitators, wherein the at least one electronic dice agitator is integral with the game table;
- enabling independent actuation of each of the plurality of electronic dice agitators;
- flashing the at least one indicator light a second color for a first period of time;
- flashing the at least one indicator light a third color a for a second period of time; and disabling, after a period of time, all of the plurality of electronic dice agitators.

11. The method of claim 10, further comprising:

receiving a tender of value, and, after receiving the tender of value, initiating a game sequence.

12. The method of claim 11, further comprising:

determining if additional credits have been tendered after disabling the at least one electronic dice agitator.

13. The method of claim 10, further comprising:

initiating a random lighting sequence of the at least one indicator light, wherein the colors displayed by the at least one indicator light include the first color, the second color and the third color.

14. A multi-player gaming system, comprising:

a table;

a controller positioned within the table;

a plurality of dice receptacles, integral with the table, each containing at least one die therein, wherein each of the plurality of dice receptacles includes a lighting component and an agitator, wherein each of the lighting components and each of the agitators are operatively connected to the controller, and wherein the agitators are electronically actuated by the controller; an input button for initiating each of the agitators;

a transparent layer positioned on the top surface of the table;

a payment system configured to accept and process a value tendered, wherein the controller is configured to actuate the agitators when the value tendered is equal to or greater than a minimum value; and a touch-sensitive computing screen supported by the table and operatively coupled to the controller, wherein the controller actuates the plurality of agitators during a first time period;

wherein each of the plurality of agitators can be actuated independently during a second time period; and wherein the controller prevents actuation of the plurality of agitators during a third time period.

15. The multi-player gaming system of claim 14, wherein each of the plurality of dice receptacles is substantially cylindrical, and wherein the bottom surface of each of the plurality of dice receptacles is positioned lower than the top surface of the table.

16. The multi-player gaming system of claim 15, wherein the lighting component is positioned circumferentially in each of the plurality of dice receptacles, and wherein the bottom surface of each of the plurality of dice receptacles is defined by the agitator.

17. A game table, comprising:

a controller;

a control button in electrical communication with the controller;

a plurality of play stations, wherein each play station includes:

a dice area including an electronically-actuated agitator in electrical communication with the controller;

an agitator control button in electrical communication with the controller; and a lighted indicator in electrical communication with the controller; and a transparent layer positioned on the top surface of the game table, wherein the transparent layer forms a top surface of the plurality of dice areas, wherein each dice area is substantially cylindrical and recessed in the table surface;

wherein the lighted indicator is disposed circumferentially in the dice area; and wherein the recess is defined at least in part by the lighted indicator and the electronically-actuated agitator.

* * * * *